US011732434B2

(12) United States Patent
Cui et al.

(10) Patent No.: US 11,732,434 B2
(45) Date of Patent: Aug. 22, 2023

(54) HIGH-RISE BUILDING SETTLING REINFORCING AND LIFTING CORRECTING CONSTRUCTION METHOD

(71) Applicant: BEIJING HENGXIANG HONGYE FOUNDATION REINFORCEMENT TECHNOLOGY CO., LTD., Beijing (CN)

(72) Inventors: Xuedong Cui, Beijing (CN); Jiguang Wu, Beijing (CN); Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 17/580,782

(22) Filed: Jan. 21, 2022

(65) Prior Publication Data

US 2022/0145575 A1 May 12, 2022

Related U.S. Application Data

(63) Continuation of application No. PCT/CN2019/107378, filed on Sep. 23, 2019.

(30) Foreign Application Priority Data

Aug. 9, 2019 (CN) ..... 201910736655.8

(51) Int. Cl.
*E02D 27/34* (2006.01)
*E02D 35/00* (2006.01)

(52) U.S. Cl.
CPC ..... *E02D 35/005* (2013.01); *E02D 27/34* (2013.01)

(58) Field of Classification Search
CPC ..... E02D 27/34; E02D 35/005
See application file for complete search history.

(56) References Cited

U.S. PATENT DOCUMENTS

2018/0363268 A1* 12/2018 Asplin ..... E02D 35/005
2022/0098819 A1* 3/2022 Cui ..... E02D 35/005
(Continued)

FOREIGN PATENT DOCUMENTS

CN 1749490 A 3/2006
CN 101487274 A * 7/2009
(Continued)

OTHER PUBLICATIONS

International search report of PCT Patent Application No. PCT/CN2019/107378 dated Apr. 29, 2020.

*Primary Examiner* — Frederick L Lagman

(57) ABSTRACT

A high-rise building settling reinforcing and lifting correcting construction method, comprising: drilling holes vertically downward around a foundation slab of a building, forming multiple curtain wall holes sunk into foundation soil at intervals; injecting slurry into the curtain wall holes, slurry ranges meshing and overlapping with each other, forming a curtain wall, the curtain wall enclosing foundation soil under the foundation slab of the building, separating foundation soil inside and outside the range of the building; providing multiple vertical reinforcement slurry injection holes on the foundation slab and injecting slurry, fully reinforcing soil near the foundation slab, forming a reinforcement body; drilling a hole downward, forming a lifting hole, pressure-injecting slurry into a bottom part of the lifting hole, the foundation soil is continuously filled and compressed, creating a lifting force, and the building gradually rising to a determined lift height.

10 Claims, 13 Drawing Sheets

(56) References Cited

U.S. PATENT DOCUMENTS

| | | | | |
|---|---|---|---|---|
| 2022/0145576 | A1* | 5/2022 | Cui | E02D 37/00 |
| 2022/0154420 | A1* | 5/2022 | Cui | E01D 22/00 |

FOREIGN PATENT DOCUMENTS

| | | | | | |
|---|---|---|---|---|---|
| CN | 101487274 | A | | 7/2009 | |
| CN | 107435346 | A | | 12/2017 | |
| CN | 108842840 | A | * | 11/2018 | |
| CN | 109056859 | A | * | 12/2018 | E02D 35/005 |
| CN | 112081153 | A | * | 12/2020 | E02D 3/12 |
| CN | 112081155 | A | * | 12/2020 | E02D 3/12 |
| CN | 112081157 | A | | 12/2020 | |
| CN | 112081158 | A | | 12/2020 | |
| CN | 110965595 | B | * | 6/2021 | E02D 15/02 |
| CN | 112942455 | A | * | 6/2021 | E02D 3/12 |
| CN | 113818500 | A | * | 12/2021 | E02D 35/005 |
| CN | 114032976 | A | * | 2/2022 | |
| KR | 101803336 | B1 | * | 12/2017 | |

* cited by examiner

HIGH-RISE BUILDING SETTLING REINFORCING AND LIFTING CORRECTING CONSTRUCTION METHOD

CROSS-REFERENCE TO RELATED APPLICATION

The present application is a continuation of international application of PCT application No. PCT/CN2019/107378 filed on Sep. 23, 2019, which claims the priority benefit of China application No. 201910736655.8 filed on Aug. 9, 2019. The entirety of the above-mentioned patent applications are incorporated herein by reference and made a part of this specification.

TECHNICAL FIELD

The invention relates to the technical field of lifting correcting and reinforcing of a settling building, in particular to a high-rise building settling reinforcing and lifting correcting construction method.

BACKGROUND ART

At present, as shown in FIG. 1, a high-rise building 1 is of a raft foundation, and a 50 cm thick plain concrete layer 95, a 5-6 m thick rubble concrete layer 94, and a broken bedrock layer 91 are sequentially arranged below the raft foundation (i.e. a foundation slab 2). There are multiple small caves 7 in the broken bedrock layer 91. The small caves 7 in the range of the foundation slab 2 are filled before the construction of building 1, but the surrounding caves 7 outside the range of the foundation slab 2 are not treated. In the construction process of the building 1, because the gravity of the building 1 is flared downwards, and the surrounding caves 7 are extruded and deformed, the settling of the building 1 is caused.

In addition, as shown in FIGS. 2 and 3, an 11-layer small high-rise building 1 is located in a semi-excavated and semi-filled area of a certain place, the west side of the building 1 is an excavation area, the east side of the building 1 is a filled area, and the original regional scene below the filled area is a watercourse 10. As shown in FIG. 3, the foundation of the building 1 is in the form of a raft foundation (i.e. a foundation slab 2), and a rubble concrete layer 94, a schist layer 93, a soft soil layer 92, and a bedrock layer 91 are sequentially arranged below the foundation slab 2 of the filled area on the east side of the building 1 from top to bottom; a rubble concrete layer 94 and a bedrock layer 91 are sequentially arranged below the foundation slab 2 on the west side of the building 1 from top to bottom; at present, uneven settling occurs to the building 1 as the maximum settling volume on the east side is 50 mm-80 mm and slight settling occurs to the west side so that lifting treatment is needed on the east side of the building 1.

How to carry out lifting correcting and reinforcing on the two buildings 1 is a technical problem to be solved.

SUMMARY

Aiming at the defects of the prior art, the object of the invention is to provide a high-rise building settling reinforcing and lifting correcting construction method, which has the advantages that a settling building can be lifted and corrected and reinforced. The lifting procedure has little effect on the building, and the foundation of the building is reinforced after lifting to prevent secondary settling.

The above object of the present invention is achieved by the following technical scheme: including the following steps:

step 1, forming a curtain wall: drilling holes vertically downward around a foundation slab of a building to form multiple curtain wall holes at intervals; injecting slurry into the curtain wall holes, slurry ranges of two adjacent curtain wall holes meshing and overlapping with each other, forming a curtain wall, and the curtain wall enclosing foundation soil under a range of the foundation slab of the building;

step 2, forming a reinforcement body: multiple vertical reinforcement slurry injection holes being provided in the foundation slab of the building, and slurry injection being carried out in the reinforcement slurry injection holes to reinforce all soil close to the foundation slab to form the reinforcement body;

step 3, lifting slurry injection: drilling a hole downward to form a lifting hole, the lifting hole penetrating from the ground to a certain depth below a bottom part of the reinforcement body, hole bottom of the lifting hole being higher than wall bottom of the curtain wall, pressure-injecting slurry being carried out on the bottom part of the lifting hole, with the continuous increase of the slurry in the curtain wall, injected slurry rapidly solidifying, the foundation soil in the curtain wall being continuously filled and compacted, and the foundation soil in the curtain wall forming lifting force along with the increase of the pressure and the compactness so that the building is lifted gradually to a determined lift height.

According to the technical scheme, pressure-injecting slurry is carried out to the bottom part of the lifting hole, along with the continuous increase and rapid solidification of slurry in the curtain wall, foundation soil in the curtain wall is filled and extruded, and with the constraint of the curtain wall, upward lifting force is formed and acts on the reinforcement body; the lifting force pushes the reinforcement body to move upwards and drives the building above to lift upwards synchronously, and finally the building is gradually lifted to a determined lift height; meanwhile, the foundation soil below the foundation slab is isolated from the foundation soil outside the foundation slab by the curtain wall, so that a closed environment is provided for the reinforcement body and lifting slurry injection, the interference of a peripheral environment is avoided, the loss of injected slurry is prevented, and slurry injection materials are saved; on one hand, the reinforcement body has the function of buffering, while transmitting the upward lifting force so that the damage to the building is mitigated, to protect the foundation slab; on the other hand, the reinforcement body has the function of reinforcing the foundation soil below the foundation slab and preventing the building from secondary settling.

The present invention is further configured as follows: in step 2, the slurry injection of the reinforcement body is carried out by adopting a drilling and injecting machine, advancing slurry injection is adopted, the slurry injection is carried out in multiple segments in the vertical direction, and the slurry solidifies within 30-60 s after being ejected from the pipe orifice of the slurry injecting pipe.

According to the technical scheme, drilling into one segment is reinforcing one segment, the foundation soil at the bottom part of the building is reinforced in time, and the disturbance of the foundation soil caused by the hole drilling which accelerates the building settling is effectively avoided.

The present invention is further configured as carrying out pressure-injecting slurry on the bottom part of the lifting hole by adopting a drilling and injecting machine, and lifting by retreating slurry injection in segments.

According to the technical scheme, it is avoided that due to continuous slurry injection at the same point or increasing slurry injection pressure, the slurry splits the foundation and further a slurry leakage channel is formed. Multiple times of retreating slurry injections are carried out so that the slurry can apply the extruding force to the surrounding foundation soil more uniformly, and the lifting is more uniform.

The present invention is further configured as follows: the foundation soil comprises a backfilled earth and stone layer, and the bottommost part of the backfilled earth and stone layer comprises one layer of soft soil layer; in step 2, the reinforcement slurry injection hole penetrates into the bottommost part of the backfilled earth and stone layer, so that all the backfilled earth and stones in the curtain wall form the reinforcement body; in step 3, lifting slurry injection hole extends into the soft soil layer for pressure-injecting slurry.

According to the technical scheme, pressure-injecting slurry is carried out in an interlayer (namely a soft soil layer) between the reinforcement body and the bedrock layer, so that lifting is more effective; the soft soil layer is more easily deformed than the backfilled schist and the like so that after it is extruded, an upward lifting force can be more efficiently formed in the curtain wall; in addition, the backfilled earth and stone layer below the foundation slab of the building is entirely reinforced so that a compact foundation structure is formed, and secondary settling of the building is effectively prevented.

The present invention is further configured as follows: the curtain wall hole penetrates into the bedrock layer.

According to the technical scheme, slurry leakage at the joint of the curtain wall and the bedrock layer is effectively prevented, and the curtain wall embedded in the bedrock layer can effectively prevent outward displacement of the bottom part of the curtain wall during lifting slurry injection.

The present invention is further configured as follows: when a cave exists right below the curtain wall hole, the curtain wall hole penetrates into the bottom part of the cave.

According to the technical scheme, slurry injection for filling and compacting is synchronously carried out on the cave so that the influence of the cave on the building is prevented.

The present invention is further configured as: in step 3, drilling a hole obliquely downward from between an edge of the foundation slab of the building and the curtain wall to form the lifting hole, wherein the lifting hole extends into the bottom part of the reinforcement body.

According to the technical scheme, hole drilling on the foundation slab is avoided, the construction is more efficient, and meanwhile, the foundation slab is protected from being damaged; in addition, because the hole is obliquely drilled from outwards to inwards, the force generated by slurry injection is facilitated to better form inward extruding force rather than in the direction of the curtain wall so that the lifting efficiency is higher.

The present invention is further configured as follows: the lifting hole extends right below a bearing wall or a structural column of the building.

According to the technical scheme, the upward force is better transmitted to the vertical main stressed structure so that the lifting is more efficient and materials are saved.

The present invention is further configured as follows: the foundation soil comprises a backfilled earth and stone layer, after lift height reaches the requirement, the hole position of an original reinforcement slurry injection hole of the building is continuously drilled downwards to the bottommost part of the backfilled earth and stone layer, the slurry injection is carried out by layering and retreating, and all backfilled earth and stones in the range of the foundation slab are strengthened and reinforced comprehensively.

According to the technical scheme, a gap is formed below the indoor foundation slab after the filled building is lifted, and meanwhile, the existing backfilled earth and stones are subjected to comprehensive slurry injection filling so that the foundation is more compact and the secondary settling of the building is prevented.

The present invention is further configured as: after the lift height reaches the requirement, drilling a hole and carrying out slurry injection at four corners of the building and/or under an indoor main bearing wall to form an irregular composite pile foundation to support and reinforce the building.

According to the technical scheme, secondary settling of the building is effectively prevented.

In summary, the invention has the following beneficial effects.

1. Pressure-injecting slurry is carried out on the bottom part of the lifting hole, along with the continuous increase and rapid solidification of the slurry in the curtain wall, by means of constraining force of the curtain wall, the extruding direction is mainly concentrated in the vertical direction and forms the lifting force, the lifting force vertically pushes the reinforcement body upwards to move upwards and drives the building above to synchronously lift upwards, and finally, the building is gradually lifted to a determined lift height;

2. the soil below the foundation slab is isolated from the soil outside the foundation slab by the curtain wall, so that a closed environment is provided for the reinforcement body and lifting slurry injection, the interference of a peripheral environment is avoided, and slurry injection materials are saved; it is suitable for lifting a building constructed on watercourse filling and a building on cave foundation;

3. on one hand, the reinforcement body, while transmitting the upward lifting force, has the function of protecting the foundation slab; on the other hand, the reinforcement body has the function of reinforcing the soil below the foundation slab and preventing the building from secondary settling;

4. supplementing slurry injection and composite pile foundation effectively reinforce the foundation and prevent secondary settling of the building;

5. during lifting slurry injection, retreating slurry injection is adopted or pressure-injecting slurry is carried out in the interlayer between the reinforcement body and the bedrock layer so that slurry injection efficiency is higher.

DETAILED DESCRIPTION

Figure 1:
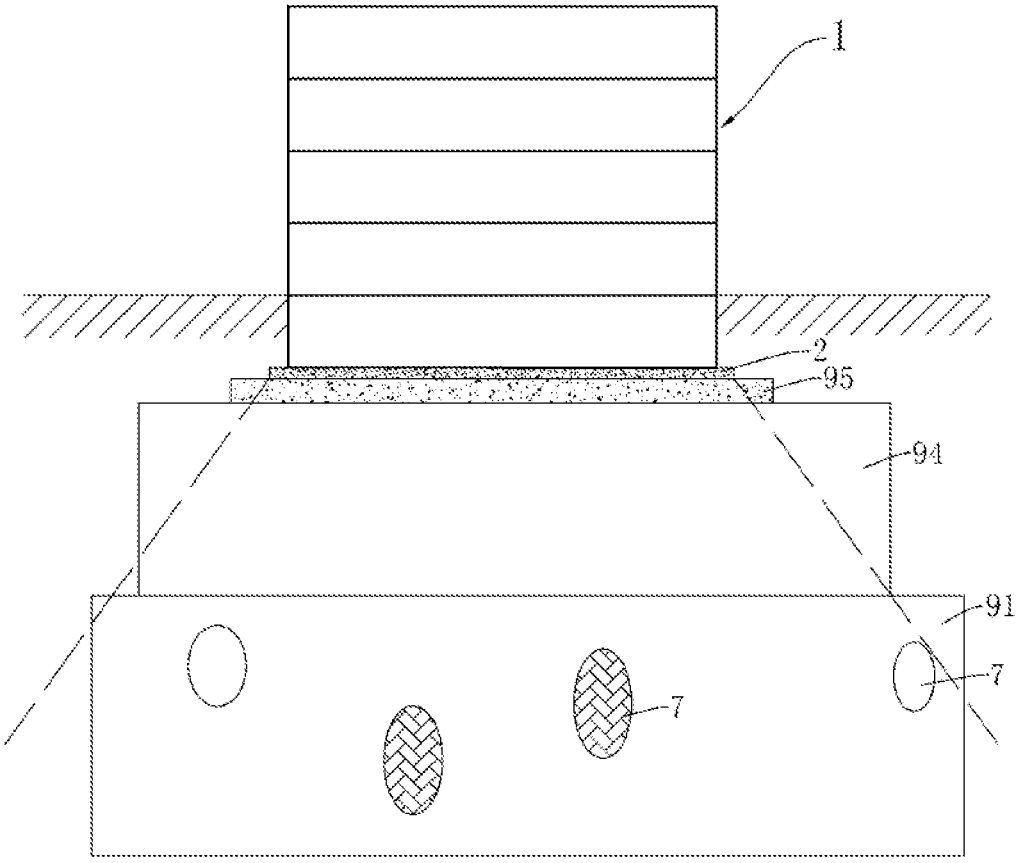
FIG. 1 (Prior Art)
FIG. 1 is a schematic view showing a structure of a settling building with caves in the foundation in the background art.

The present invention will be described below in further detail with reference to the accompanying drawings. Like components and parts are denoted by like reference numerals. It should be noted that the words "front", "rear", "left", "right", "upper", "lower", "bottom surface" and "top surface" used in the following description refer to the direction in the drawing, and the words "inner" and "outer" respectively refer to directions toward or away from the geometric center of a particular component.

In the following, foundation slab 2 of building 1 represents the raft foundation in the background and the concrete slab at the bottom of the foundation such as the box foundation of the building 1. The foundation soil includes the original foundation or the foundation treated by processes such as compaction pile or dynamic compaction and the like, and the foundation can also be a "backfilled earth and stone layer" foundation formed by backfilling the original foundation. The "backfilled earth and stone layer" represents one or more backfilled structures such as backfilled earth, backfilled gravel, backfilled schist, or backfilled rubble concrete. The "bedrock layer 91" in the present application represents not only a true-sense bedrock with high strength, but also an undisturbed soil layer with high bearing capacity.

Embodiment 1

A method for lifting and reinforcing a settling building 1 having a cave 7 at the bottom part in the background art is described, in which case the foundation soil at the bottom part of the building in the embodiment includes a backfilled earth and stone layer. A high-rise building settling reinforcing and lifting correcting construction method includes the following construction steps.

Figure 4:
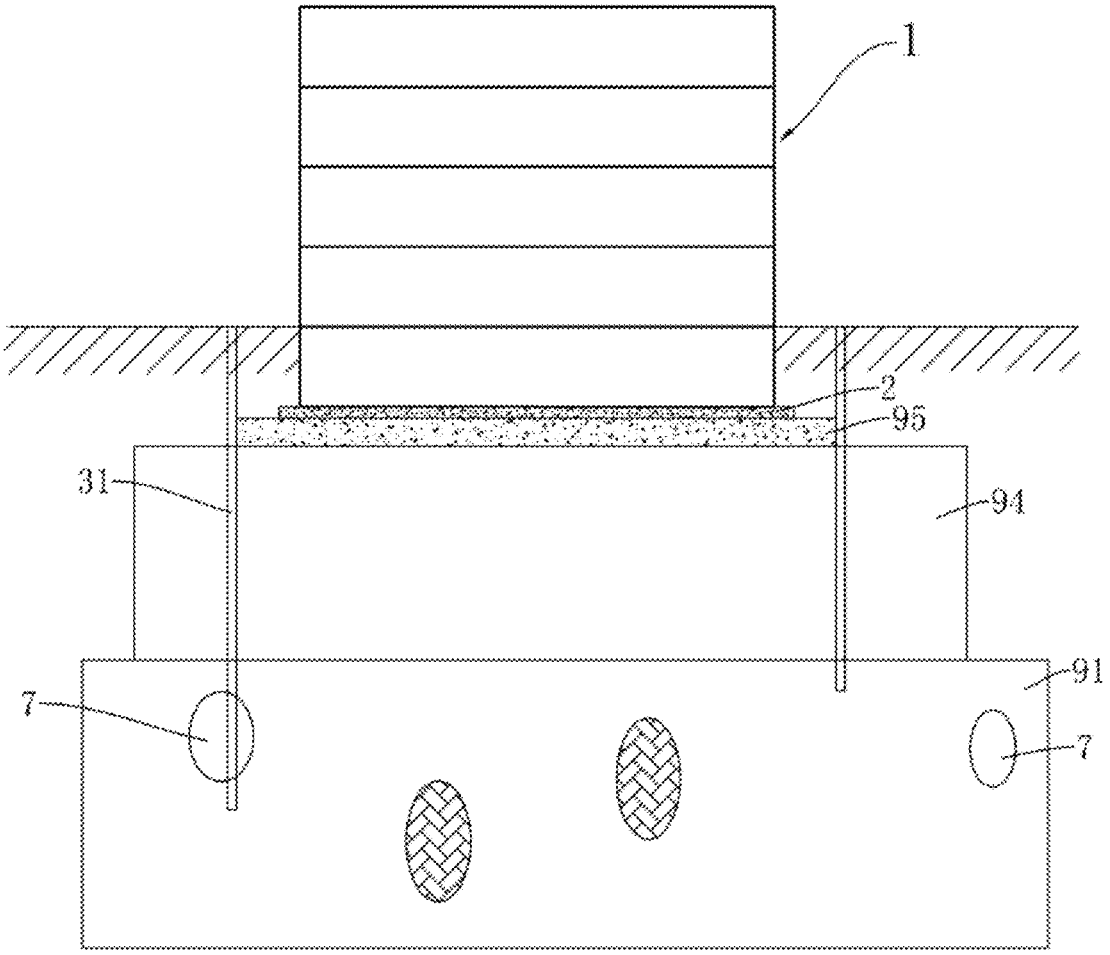
FIG. 4 is a schematic view of a construction curtain slurry injection hole in embodiment 1.
Figure 5:
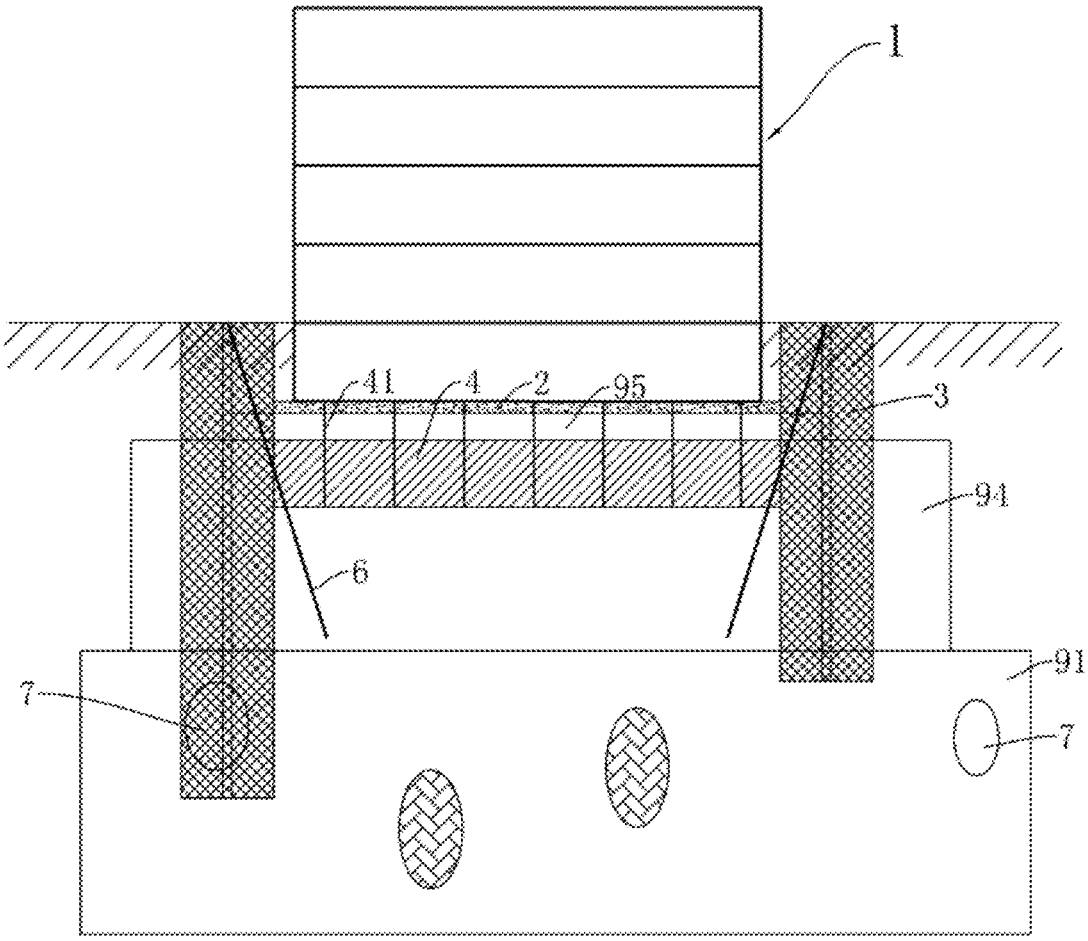
FIG. 5 is a schematic view of forming a curtain wall and reinforcement body and lifting slurry injection constructing in embodiment 1.

Step 1, forming a curtain wall 3: as shown in FIGS. 4 and 5, drilling holes vertically downward around a foundation slab 2 of a building 1 to form multiple curtain wall holes 31 at intervals; the distance between hole position and the outer wall being about 2.0 m-2.7 m and the distance between holes being 2.0 m. The hole drilling depth is determined according to geological exploration data combined with the actual hole drilling conditions. Generally, the curtain wall hole 31 extends into the bedrock layer 91 for 1 m. When there is a cave 7 directly below the curtain wall hole 31, the curtain wall hole 31 extends to the bottom part of the cave 7 and penetrates through the cave 7 into the rock for 1.0 m. The curtain wall hole 31 is constructed by a hole jumping method, and slurry injection is carried out into the curtain wall hole 31 by a drilling and injecting machine. The slurry ranges of two adjacent curtain wall holes 31 mesh and overlap with each other to form a curtain wall 3 with an effective thickness of 3.0 m. The curtain wall 3 encloses the rubble concrete layer 94 below the foundation slab 2 of the foundation of the building 1. The slurry injecting pressure in the curtain wall hole 31 is determined according to the designed thickness of the curtain wall and the stratum, and is generally 0.3-0.5 MPa.

Step 2, forming a reinforcement body 4: providing multiple vertical reinforcement slurry injection holes 41 in the foundation slab 2 inside the building 1, the reinforcement slurry injection holes 41 being arranged in a cinquefoil shape of 3.0×2.8 m, the holes being vertically drilled, and the bottom of the hole extending into the rubble concrete layer 94. Then slurry injection is carried out in the reinforcement slurry injection hole 41, slurry injection reinforcing and strengthening is carried out in the range of 2.0 m below the foundation slab 2, and the gap in the rubble concrete in the range is filled and compacted to form a reinforcement body 4; the purpose is to improve the compactness and rigidity of the backfilled rubble concrete layer 94; the buffer strip function can be realized in lifting operation so that lifting stress is more uniform.

The slurry injection of the reinforcement body 4 is carried out by adopting a drilling and injecting machine, advancing slurry injection is adopted, the slurry injection is carried out in multiple segments in the vertical direction, and the slurry solidifies within 30-60 s after being ejected from the pipe orifice of the slurry injecting pipe. The depth of each advance may be 30-50 cm.

Step 3, lifting slurry injection: as shown in FIG. 5, after the construction of the reinforcement body 4 in step 2 is completed for 12-24 h, holes are distributed on the settling side of the building 1, the lifting holes 6 are drilled, the distance between the hole position and the outer wall is about 2.89 m, and the hole distance is 4 m. The lifting hole 6 is inclined downwards from the ground to 3-5 m below the bottom part of the reinforcement body 4, and the angle of the hole drilling enables the bottom of the hole to extend right below a bearing wall or a structural column of the building 1. The hole bottom of the lifting hole 6 is higher than the wall bottom of the curtain wall 3. The hole drilling and slurry injection of the lifting hole 6 are carried out by adopting a drilling and injecting machine. A reinforced concrete structure such as a raft foundation and the like is avoided in the hole drilling process so that the drilling is prevented from being blocked.

Then sectional retreating slurry injection lifting is adopted. Specifically, after drilling to a determined depth, pressure-injecting slurry is carried out on the bottom of the lifting hole 6. With the continuous increase of the slurry in the curtain wall 3, the injected slurry is rapidly solidified, and the backfilled soil and stones in the curtain wall 3 are continuously filled and compacted. The backfilled earth and stones in the curtain wall 3 form lifting force along with the increase of the pressure and the compactness so that the building 1 is lifted slowly. When the slurry injection is carried out for a certain time, under the same pressure, the injection speed of the slurry is continuously slowed down. At the moment, the slurry injecting pipe is retreating by 10-30 cm, pressure-injecting slurry is continuously carried out, and the slurry is continuously injected into the curtain wall 3 after multiple retreatments so that the backfilled earth and stones in the range are filled and compacted to enable the building 1 to be continuously lifted to a determined lift height. In order to lift the building 1 to a determined lift height before the slurry outlet of the slurry injecting pipe retreats to the bottom surface of the reinforcement body 4, generally, the hole bottom of the lifting hole 6 extends to 3-5 m below the bottom of the reinforcement body 4, and the retreating distance each time can also be adjusted according to actual conditions. The slurry injecting pressure setting principle in the pressure-injecting slurry process is as follows: reference pressure==gravity of the entire building 1/area of the foundation slab 2, where the slurry injecting pressure should be greater than the reference pressure and less than 1.8 times of the reference pressure. The slurry injecting pressure in the reinforcement slurry injection hole 41 in step 2 and the strengthening slurry injecting pressure in step 4 should both be less than or equal to the reference pressure.

Figure 6:
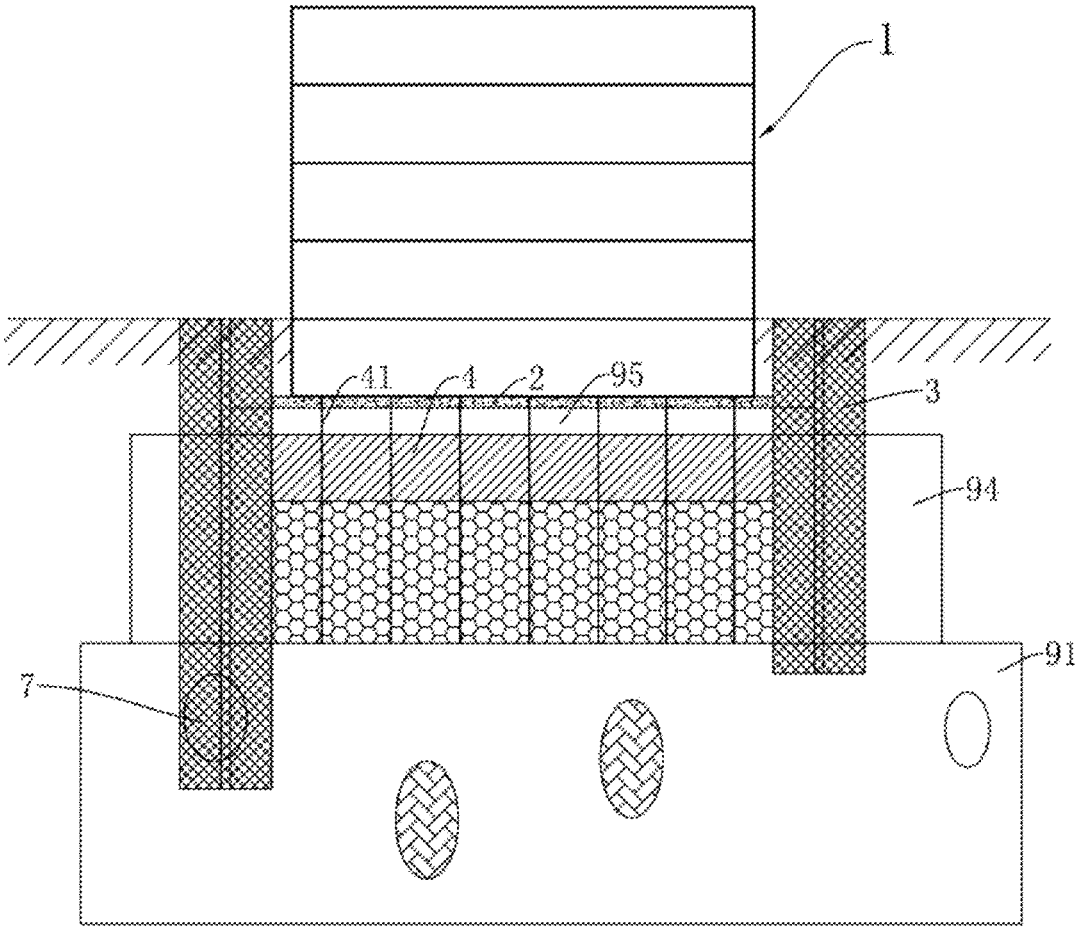
FIG. 6 is a schematic view of slurry injection strengthening construction in embodiment 1.

Step 4, slurry injection strengthening of backfilled earth and stones:

as shown in FIG. 6, after the lift height reaches the requirement, the original hole position of the reinforcement slurry injection hole 41 in the building 1 is continuously drilled downwards to the bottommost part of the backfilled rubble concrete, the slurry injection is carried out by layering and retreating, and all backfilled earth and stones in the range of the foundation slab 2 are strengthened and reinforced comprehensively so that the rigidity, compactness and foundation bearing capacity are improved, and secondary sinking is prevented. The pressure of the filled slurry injection is 0.3-0.5 MPa.

Figure 7:
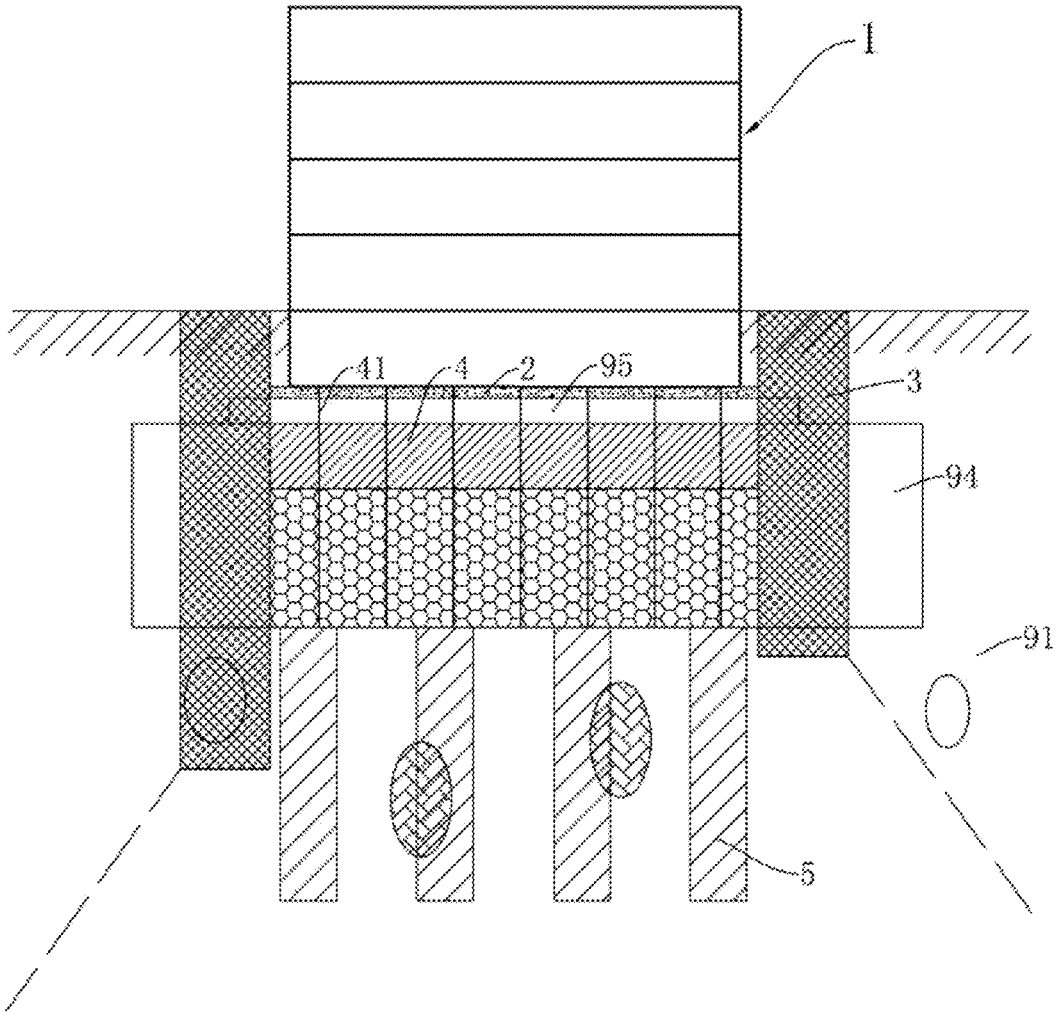
FIG. 7 is a schematic view of composite pile foundation construction.

Step 5, injecting slurry to form a composite pile foundation 5: as shown in FIG. 7, in order to ensure the overall stability and durability of the building foundation, eight irregular composite pile foundations 5 are applied to the four corners of the building 1 and positions below the indoor main bearing walls. The composite pile foundation 5 is formed through repeated retreating and advancing slurry injection. The karst cracks are filled. The effective diameter of the irregular composite pile foundation 5 is not less than 3 m, and the depth of the composite pile foundation 5 is 15.0 m below the foundation slab 2. The irregular composite pile foundation 5 and the composite foundation strengthening and reinforcing body formed by slurry injection in steps 2 and 4 form a whole to jointly bear the above load, and the building 1 is supported and reinforced so that the overall stability and durability requirements of a reinforced area are realized. The specific construction steps of the composite pile foundation 5 can be seen in two patent application documents filed by the applicant on Jun. 4, 2019, the application numbers of which respectively being: 201910517287.8 and 201910518029.1.

The implementation principle of the embodiment is as follows: lifting slurry injection is carried out in the enclosed curtain wall 3, the slurry injected into the curtain wall is continuously solidified and presses the surrounding soil, the slurry is not scattered due to the isolation of the curtain wall 3, and the pressing direction of the soil is restrained by the curtain wall 3 so that the pressing direction is mainly concentrated downwards and upwards. The upward force acts on the reinforcement body 4, and the reinforcement body 4 moves upwards and drives the building 1 above to lift upwards synchronously so that the purpose of lifting and inclination correcting is achieved.

The curtain wall 3 also forms a barrel structure, changing the distribution of the gravity of the building 1 in the foundation. Comparing FIG. 1 with FIG. 7, in FIG. 1, before lifting and reinforcing, the gravity of the building 1 is distributed trumpet-shaped downward from the foundation slab 2, thereby pressing the formation of the caves 7 around the building 1, causing the building 1 to settle. In FIG. 7, after reinforcing and strengthening body construction is carried out on the curtain wall 3 and the internal composite foundation, the gravity of the building 1 can be integrally extended downwards to the bottom of the curtain wall 3, and then starts to be distributed downwards in a trumpet shape so that the influence of the surrounding caves 7 on the building 1 is effectively reduced, and a more stable foundation structure is formed.

Embodiment 2

Figure 2:
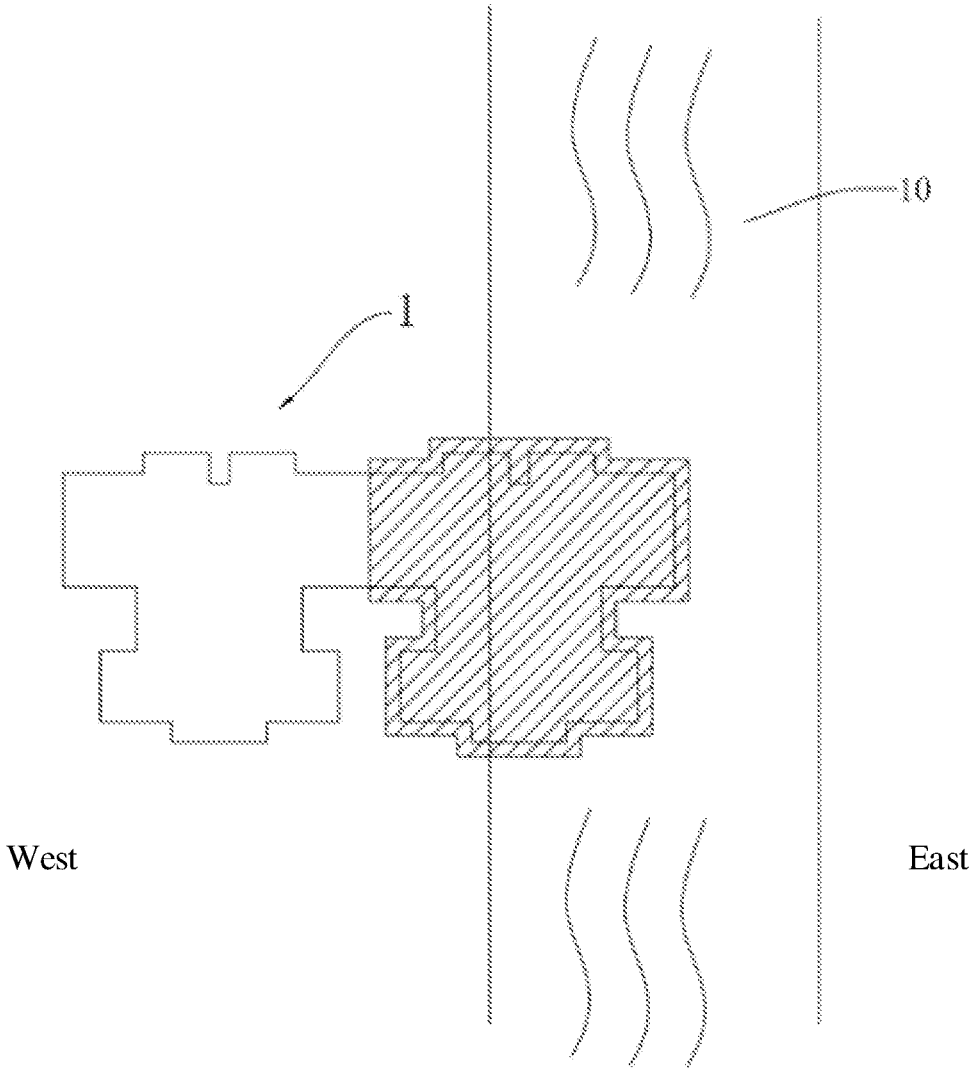
FIG. 2 (Prior Art)
FIG. 2 is a schematic plan view of a building half-built on a backfilled watercourse in the background art.
Figure 3:
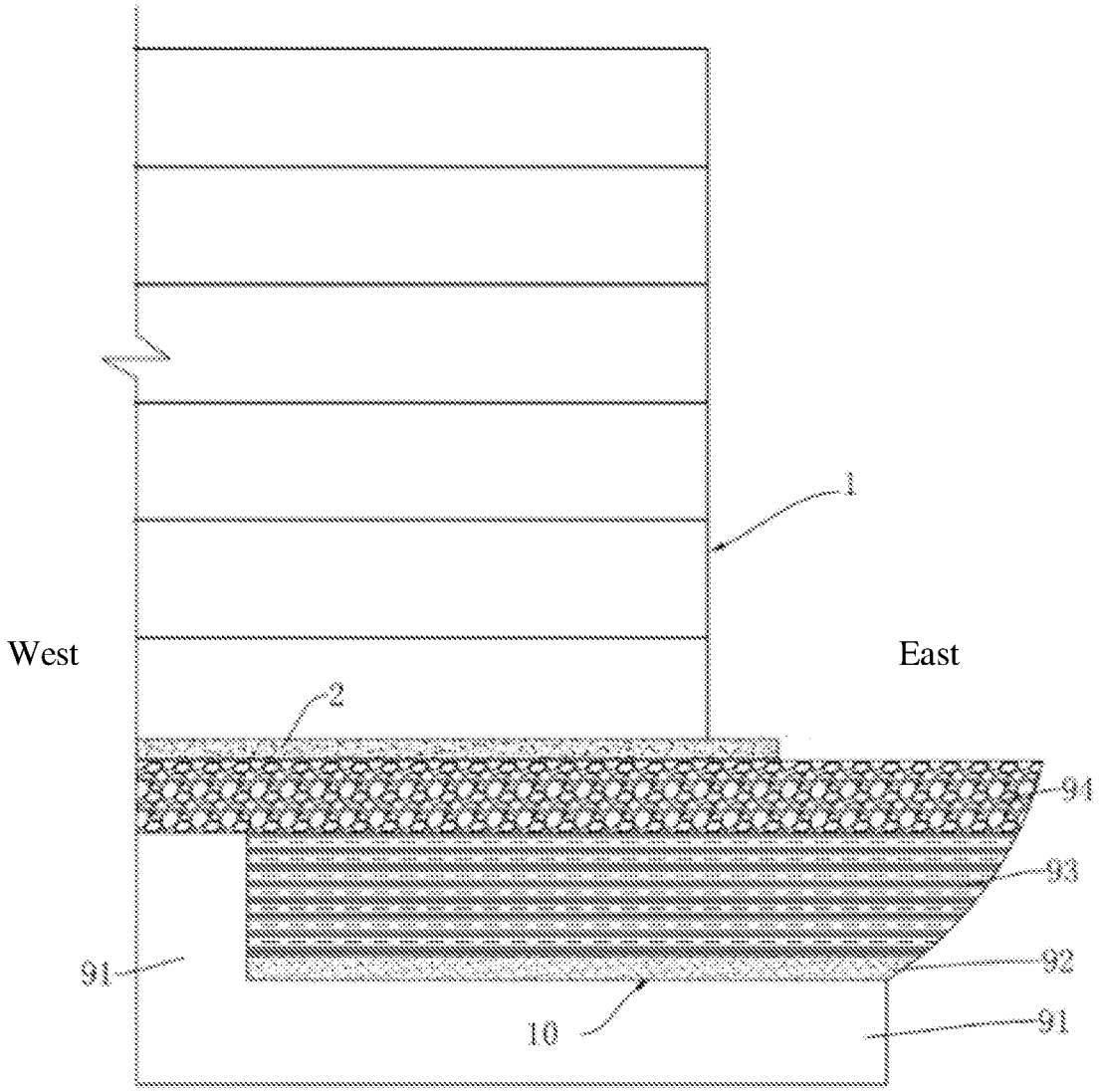
FIG. 3 (Prior Art)
FIG. 3 is a schematic view of a geological segment of a building whose bottom part is half-built on a backfilled watercourse in the background art.

As shown in FIGS. 2 and 3, foundation slab 2 of the foundation of building 1 is located half in the excavation area and half in the filled area, and the building 1 is settled on one side of the filled area. The method for reinforcing and lifting includes the following construction steps.

Figure 8:
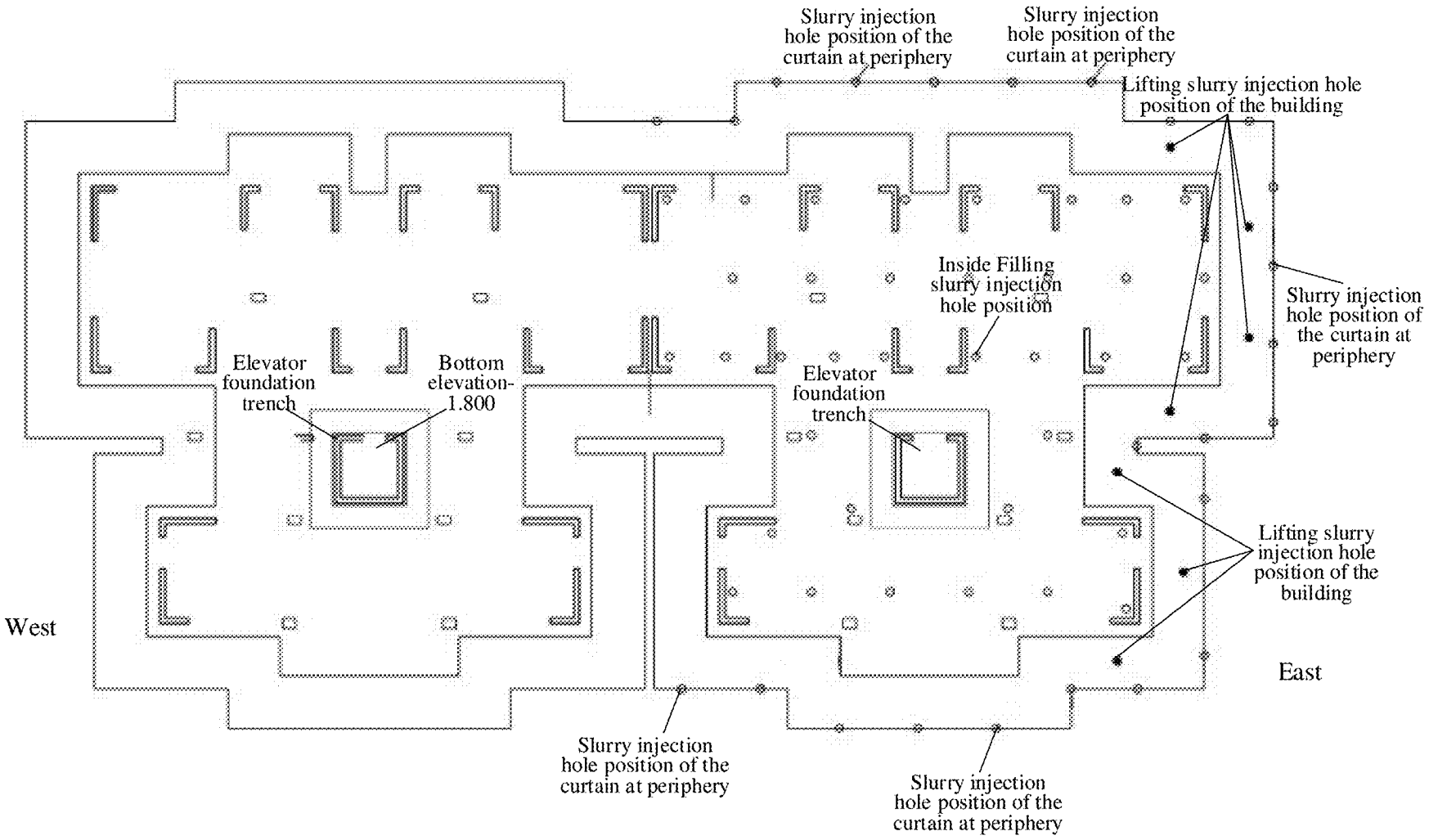
FIGS. 8-9 are schematic plan views of a curtain wall, a reinforcement slurry injection hole, and a lifting hole in embodiment 2.
Figure 9:
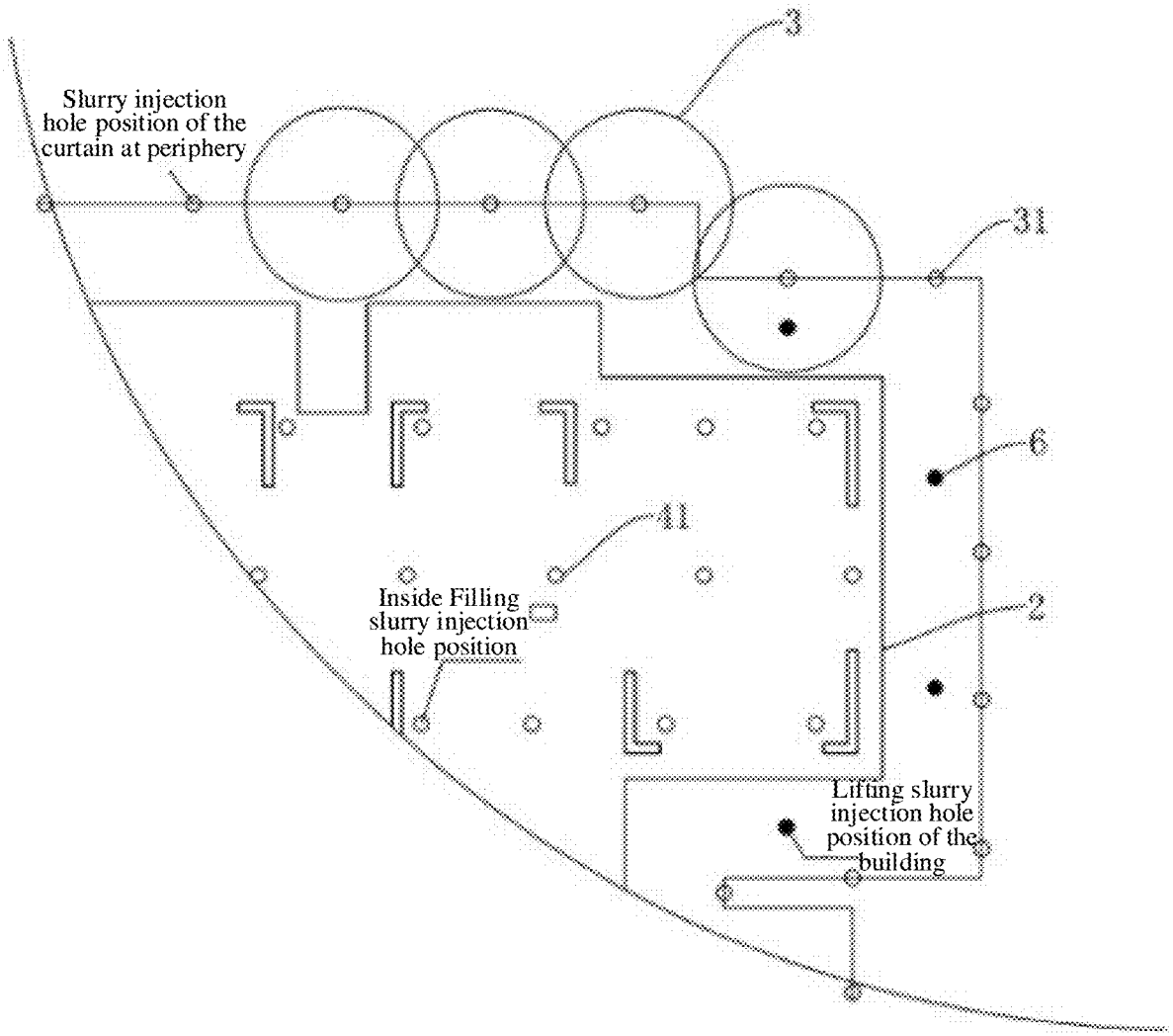
Figure 10:
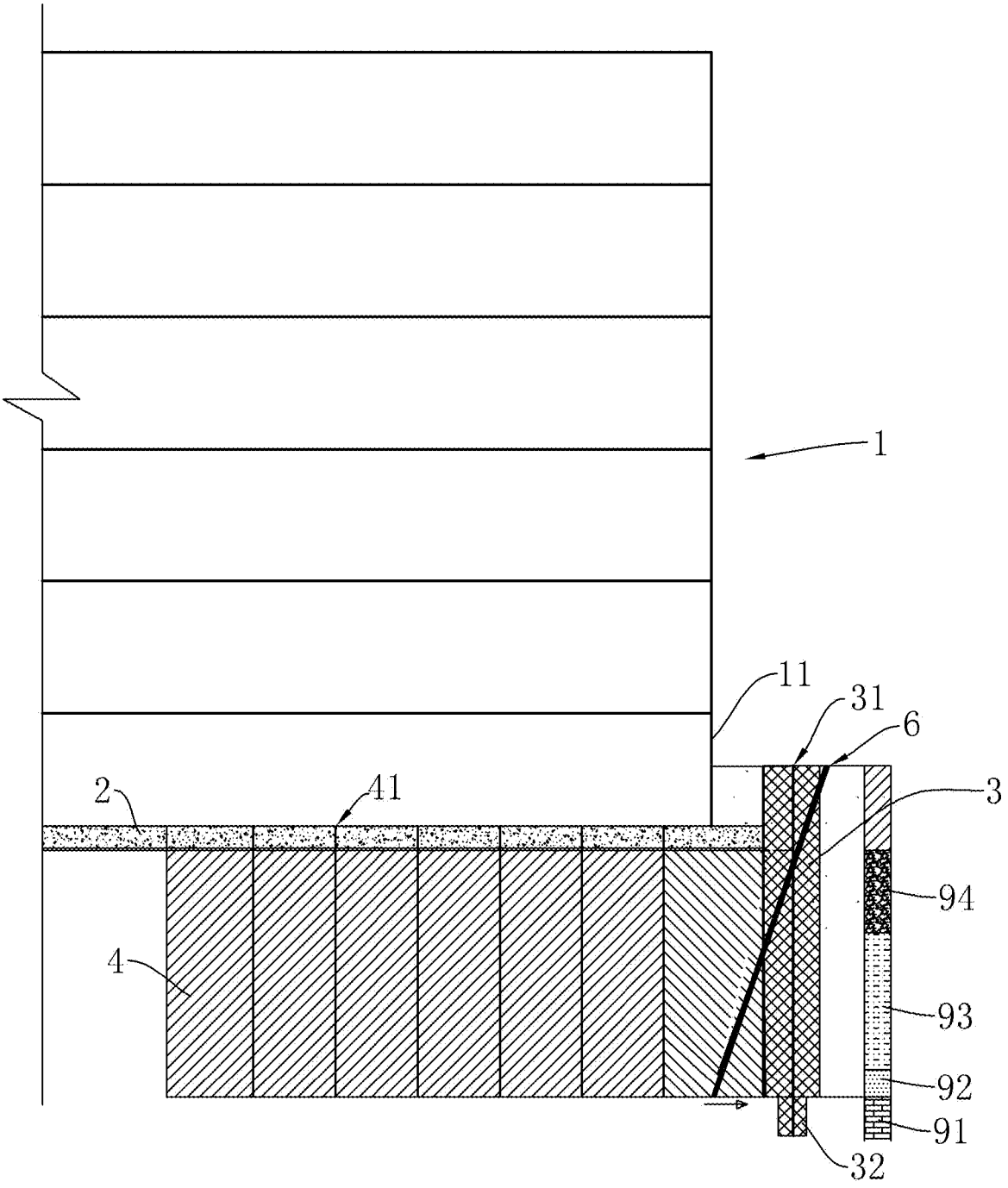
FIG. 10 is a schematic cross-sectional view of reinforcing and lifting in embodiment 2.

Step 1, forming a curtain wall 3: referring to FIGS. 8 to 10, drilling holes vertically downward around the foundation slab 2 of the foundation of the building 1 to form multiple curtain wall holes 31 at intervals in the filled area, the curtain wall holes 31 penetrating to the bottommost part of the filling. Then slurry injection is carried out into the curtain wall hole 31, the slurry ranges mesh and overlap with each other to form a U-shaped curtain wall 3, the curtain wall 3 encloses the backfilled stone layer below the foundation slab 2 of the foundation of the building 1, and the backfilled earth and stones inside and outside the range of the building 1 are isolated. Preferably, the curtain wall hole 31 penetrates into the bedrock layer 91 below the bottommost part of the filling, and the bottom end of the curtain wall 3 after slurry injection is completed can form the connecting pile body 32 extending into the bedrock layer 91, thereby preventing the bottom of the curtain wall 3 from horizontally moving.

Step 2, forming a reinforcement body 4: in the filled area inside the curtain wall 3, multiple vertical reinforcement slurry injection holes 41 are provided in the foundation slab 2 of the foundation of the building 1, the reinforcement slurry injection holes 41 penetrate to the bottommost part of the backfilled earth and stone layer, and pressure-injecting slurry is carried out in the reinforcement slurry injection holes 41 to reinforce all of the backfilled rubble concrete layer 94, the schist layer 93 and the soft soil layer 92 below the foundation slab 2 to form the reinforcement body 4.

Step 3, lifting slurry injection: in step 3, obliquely drilling a hole downwards from between the edge of the foundation slab 2 of the foundation of the building 1 and the curtain wall 3 to form a lifting hole 6, wherein the lifting hole 6 extends into the soft soil layer 92 at the bottom of the reinforcement body 4, and pressure-injecting slurry is carried out in the interlayer (i.e. the soft soil layer 92) of the reinforcement body 4 and the bedrock layer 91, and as the slurry in the curtain wall 3 is continuously increased and rapidly solidified and the restraining force of the curtain wall 3 is utilized, the acting force vertically pushes the reinforcement body 4 to move upwards and drives the building 1 above to lift upwards synchronously, and finally the building 1 is gradually lifted to a set lift height, and then slurry injection is stopped, and the lifting slurry injection pipe is pulled out. The soft soil layer 92 is more easily deformed than the backfilled schist and the like so that after it is extruded, an upward lifting force can be more efficiently formed in the curtain wall. Preferably, the lifting hole 6 extends right below the peripheral bearing wall 11 of the building 1 so that the lifting force more efficiently lifts the building 1. The slurry injection pressures of various slurries of the embodiment refer to embodiment 1.

The implementation principle of the embodiment is as follows: a three-sided enclosed curtain wall 3 is formed in a slurry injection mode and is connected with an excavation area to form an enclosure, and meanwhile the soil at the bottom of the lifting side foundation slab 2 of the building 1 is isolated from filling earth outside the range of the building 1. Lifting slurry injection is carried out in the enclosed curtain wall 3, and the slurry injected into the curtain wall is continuously solidified and presses the surrounding soil. The slurry is not scattered due to the isolation of the curtain wall 3, and the pressing direction of the soil is restrained by the curtain wall 3 so that the pressing direction is mainly concentrated downwards and upwards. The upward force acts on the reinforcement body 4, and the reinforcement body 4 moves upwards and drives the building 1 above to lift upwards synchronously so that the purpose of lifting and inclination correcting is achieved. The curtain wall 3 also has the function of isolating the inner soil and the outer soil, so that the influence of the external environment on slurry injection when the slurry injection is carried out in the curtain wall 3 is avoided. For example, the curtain wall 3 can have the function of isolating underground river interference to prevent the slurry injection liquid from being washed away.

Embodiment 3

Figure 11:
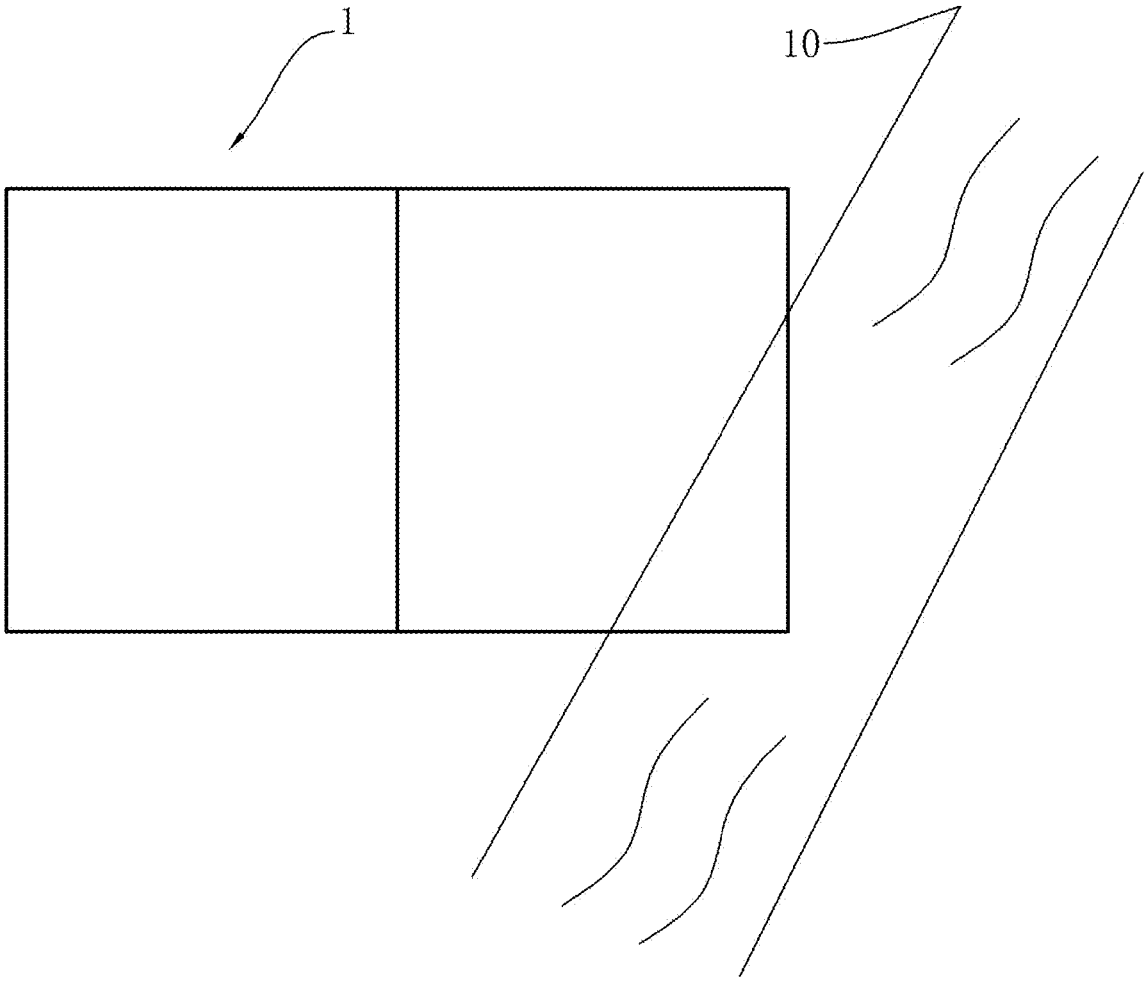
FIG. 11 is a schematic plan view of a building with a corner located on a backfilled watercourse in embodiment 3.
Figure 12:
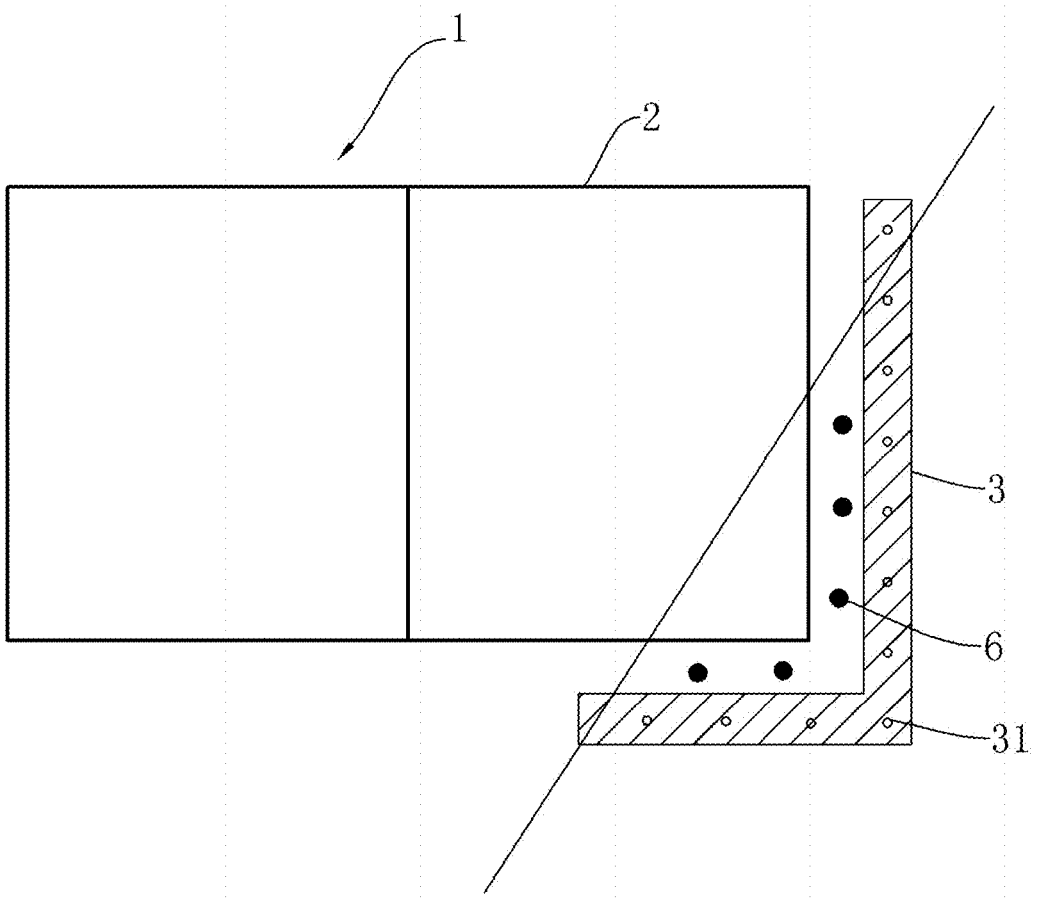
FIG. 12 is a schematic plan view of an L-shaped curtain wall, a reinforcement slurry injection hole, and a lifting hole in embodiment 3.

As shown in FIGS. 11 and 12, foundation slab 2 of the foundation of building 1 is mostly located in the excavation area, only one corner is located in the filled area of an existing watercourse 10, and the building 1 is settled only at the corner. In this case, the following is only needed: the construction of a curtain wall hole 31 is carried out on the two sides at the corner, and an L-shaped curtain wall 3 is formed by slurry injection and connected with the excavation area. Then the filling earth area below the foundation slab 2 is reinforced by slurry injection; and finally, a lifting slurry injection hole is constructed obliquely downwards between the curtain wall 3 and the foundation slab 2 of the building 1, and lifting pressure slurry injection is performed at the bottom of the reinforcement body 4.

Embodiment 4

Figure 13:
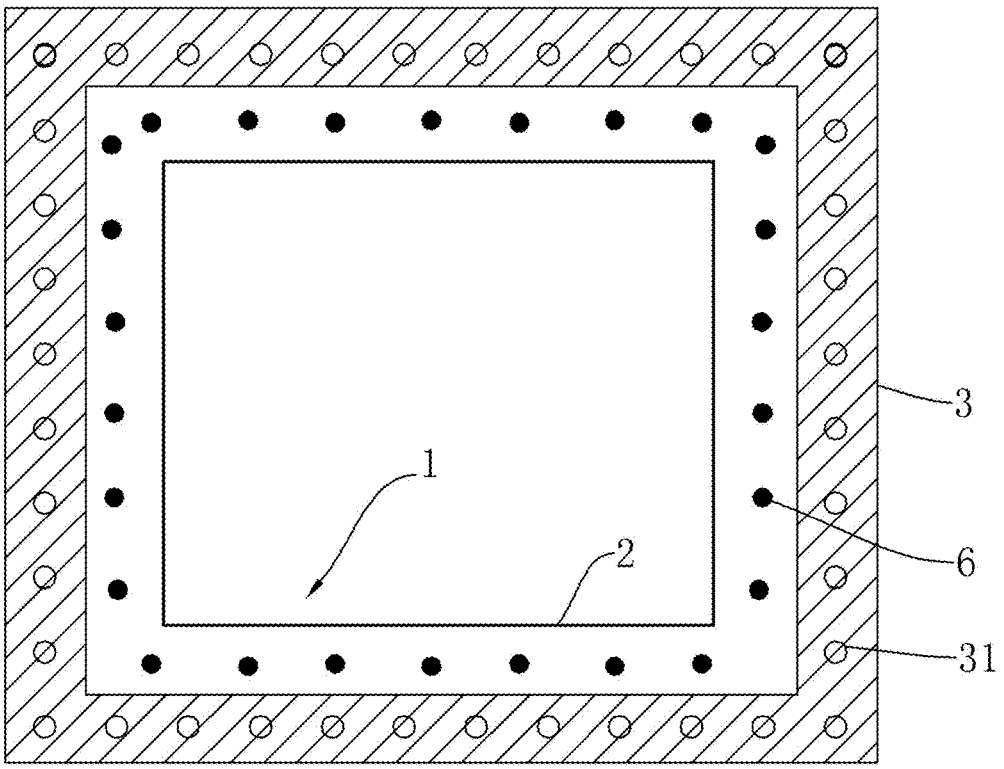
FIG. 13 is a schematic plan view of a closed curtain wall formed around a foundation slab of a building in embodiment 4.

As shown in FIG. 13, foundation slab 2 of building 1 is entirely located on a backfilled earth and stone layer.

In the drawing, the building 1 integrally settles and needs to be lifted integrally. Therefore, a closed curtain wall 3 is applied to the periphery of the foundation slab 2 of the building 1, the soil below the foundation slab 2 is injected with slurry to form a reinforcement body 4, then a lifting hole 6 is applied, and lifting slurry injection is carried out.

When the thickness of the backfilled earth and stone layer between the foundation slab 2 and the bedrock layer 91 is greater than 10 m, the curtain wall hole 31 may be selected not to penetrate into the bedrock layer 91 in consideration of the uneconomical construction of a curtain wall 3 which is too high. In this case, after lifting slurry injection is carried out with reference to embodiment 1, a composite pile foundation 5 is constructed to a bearing layer such as the bedrock layer 91 to prevent secondary settling of the building 1.

Figure 14:
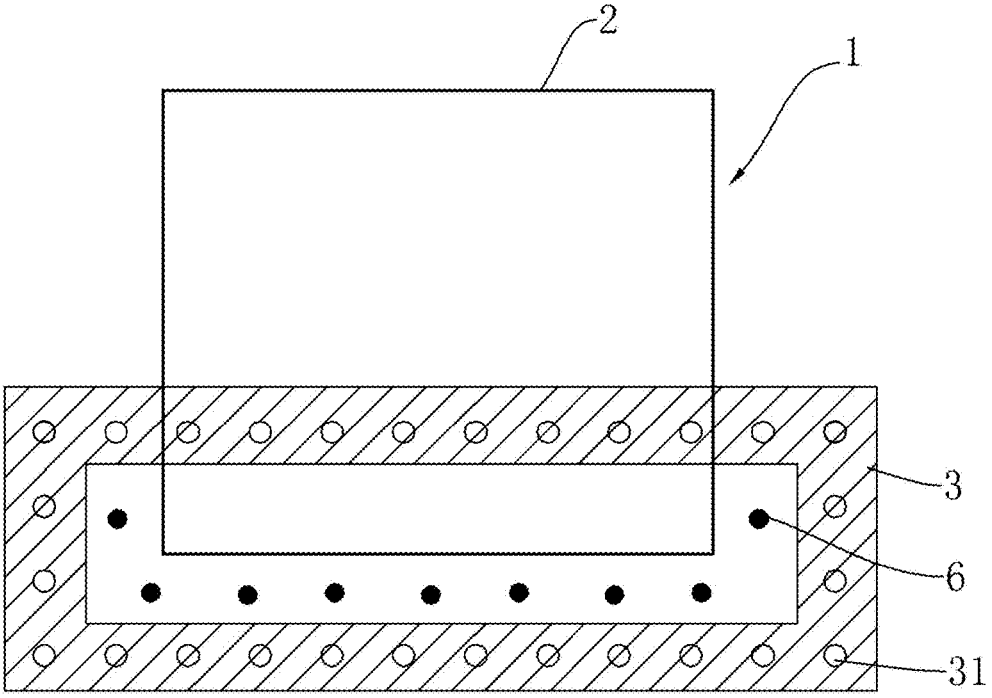
FIG. 14 is a schematic plan view of a closed curtain wall formed at the lifting side of a building in embodiment 4.

As shown in FIG. 14, it is shown that the building 1 is entirely located on the backfilled earth and stone layer in the filled area, but only one side of the building 1 settles and only this side needs to be lifted. Therefore, the curtain wall 3 can be applied to the foundation slab 2 on the lifting side of the building 1 and the periphery of the foundation slab 2, then the construction of the reinforcement body 4 is carried out on the lower part of the foundation slab 2 in the curtain, or the soil below the foundation slab 2 is entirely reinforced. Finally, a lifting hole 6 is constructed at the lifting side to the bottom part of the bearing wall, and pressure-injecting slurry is carried out to lift the building 1.

In order to prevent the foundation soil below the foundation slab 2 from being softened and further causing the accelerated settling of the building 1 by the injected slurry in the construction procedure of the reinforcement body 4, the slurry adopted in the slurry injection of the reinforcement body 4 is of a quick-setting type. Preferably, the slurry solidifies within 30-60 s after being ejected from the pipe orifice of the slurry injecting pipe. The slurry used for slurry injection can be a single slurry or double slurry. When the double slurry is adopted, different slurries reach the slurry outlet through different channels of the double-layer slurry injecting pipe, and are pressed into the soil together after converging at the slurry outlet, and solidification reaction occurs.

The foundation slab 2 of the building 1 can be perforated by adopting a drilling machine such as a water drill and the like, then the reinforcement slurry injection hole 41 and the reinforcement body 4 are constructed by adopting a drilling and injecting machine, and slurry injection is carried out for many times in multiple segments vertically. A retreating slurry injection process can be adopted, namely drilling to a designed hole depth at one time, and then falling backing a drill rod (i.e. a slurry injecting pipe) in segments and carrying out slurry injection; an advancing slurry injection process can also be adopted, namely drilling into one segment and carrying out slurry injection on one segment. The distance for each advance or retreat of the drill rod should be less than the diffusion radius of the slurry. When the backfilled earth and stone layer includes schists or block stones, advancing drilling slurry injection is preferred. Because when the block stone is perforated, too much water discharged from the end of the drill rod causes the surrounding soil to soften, and at the moment, one segment is drilled and slurry is injected into one segment so that the accelerated settling of the building 1 can be effectively prevented. For other soil layers, a retreating slurry injection process can be adopted.

The operation is convenient, and the efficiency is higher.

The injected slurry in the lifting hole 6 is preferably of the quick-setting type likewise, capable of solidifying in 5-30 s. Preferably, double slurry injection is adopted. Different slurries reach the slurry outlet through different channels of the double-layer slurry injecting pipe, and are pressed into the soil together after converging at the slurry outlet, and solidification reaction occurs.

The above-mentioned double slurries are respectively named slurry A and slurry B. The two slurries respectively reach the slurry outlet of the slurry injecting pipe from different channels of the drill rod, the surrounding soil is pressed into the slurry outlet, the two slurries chemically react after converging in the soil, and the initial setting is completed in a short time.

The injected slurry can be any one of the prior art as long as it can meet the initial setting time requirement and has good permeability. The above-mentioned solidification of the injected slurry represents the initial setting as long as the injected slurry is not liquid but solid with a certain strength after the rapid initial setting, and the main purpose is to prevent the softening effect of the liquid injected slurry on the foundation of the building 1.

The following injected slurry formula can be adopted: slurry A consists of the following raw materials in parts by weight: 70-90 parts of metal oxide and/or metal hydroxide, 0.5-1.2 parts of composite retarder, 0.5-0.7 parts of water reducer, 0.7-1.5 parts of acid-base buffer agent, 3-5 parts of composite stabilizer, and 0.5-1.5 parts of composite surfactant. The oxidation metal can be a combination of any two of magnesium oxide, aluminum oxide, magnesium phosphate and the like; the composite retarder is urea and sodium tripolyphosphate; the water reducer is a polycarboxylic acid water reducer; the acid-base buffer agent is magnesium carbonate or potassium hydroxide; the composite stabilizer is at least two of hydroxymethyl cellulose, n-alkyl cetyl alcohol, starch ether, and cellulose ether; the composite surfactant is at least two of alkyl polyoxyethylene ether, benzyl phenol polyoxyethylene ether, and alkane sulfonate. When two or more different materials mentioned above are used in each of the above separate components, they can be formulated in an equal order of magnitude, the two being arranged primarily to prevent one from failing so that the overall composite slurry effect is more stable.

Slurry B consists of the following raw materials in parts by weight: 30-40 parts of phosphate and 0.2-1 parts of the defoaming agent. The phosphate can be diammonium hydrogen phosphate or potassium dihydrogen phosphate; the defoaming agent can be the organosilicon defoaming agent or polyether defoaming agent.

Slurry A and slurry B are mixed with water in a weight ratio of 100:40-50 respectively to be stirred to form a slurry, and are pressed into the slurry injecting pipe via different pipelines, converge at the slurry outlet and react, and solidify in the soil.

The difference of the initial setting time of the composite slurry is mainly realized by adjusting the specific gravity of the composite retarder. Preferably, during the pressure-injecting slurry in the lifting procedure, less water is added, so that the concentration of the injected slurry is increased and the surrounding soil can be better extruded (for example, slurry A and slurry B are respectively in a weight ratio of 100:40 with water); in other slurry injections, more water is added and the concentration of the injected slurry should be small (for example, slurry A and slurry B are respectively in a weight ratio of 100:50 with water).

The specific embodiments are merely illustrative of the invention and are not intended to limit the invention. Those skilled in the art, after reading the present description, may make modifications to the embodiments as needed without inventive contribution, and the modifications are protected by the Patent Law insofar as they come within the scope of the appended claims.

Reference numerals: 1, building; 11, peripheral bearing wall; 2, foundation slab; 3, curtain wall; 31, curtain wall hole; 32, connecting pile body; 4, reinforcement body; 41, reinforcement slurry injection hole; 5, composite pile foundation; 6, lifting hole; 7, cave; 91, bedrock layer; 92, soft soil layer; 93, schist layer; 94, rubble concrete layer; 95, plain concrete layer; 10, watercourse.

What is claimed is:

1. A high-rise building settling reinforcing and lifting correcting construction method, comprising:

step 1, forming a curtain wall: drilling holes vertically downward around a foundation slab of a building to form multiple curtain wall holes at intervals; injecting slurry into the curtain wall holes, wherein slurry zones of two adjacent curtain wall holes meshes and overlaps with each other; and forming a curtain wall, wherein the curtain wall encloses foundation soil under a range of the foundation slab of the building;

step 2, forming a reinforcement body: providing multiple vertical reinforcement slurry injection holes in the foundation slab of the building, and injecting slurry in the reinforcement slurry injection holes to reinforce all soil close to the foundation slab to form the reinforcement body; and step 3, lifting slurry injection: drilling a hole downward to form a lifting hole, wherein the lifting hole penetrates from the ground to a certain depth below a bottom part of the reinforcement body, hole bottom of the lifting hole is higher than wall bottom located on the curtain wall; pressure-injecting slurry on the bottom part of the lifting hole, wherein, with continuous increase of the slurry in the curtain wall, injected slurry rapidly solidifies, the foundation soil enclosed by the curtain wall is continuously filled and compacted, and the foundation soil enclosed by the curtain wall form lifting force with increase of pressure and compactness such that the building is lifted gradually to a determined lift height.

2. The high-rise building settling reinforcing and lifting correcting construction method according to claim 1, wherein, in step 2, the injecting slurry into the reinforcement body is carried out by adopting a drilling and injecting machine, advancing slurry injection is adopted, the slurry injection is carried out in multiple segments in a vertical direction, and the slurry solidifies within 30-60 s after being ejected from a pipe orifice of a slurry injecting pipe.

3. The high-rise building settling reinforcing and lifting correcting construction method according to claim 1, wherein the pressure-injecting slurry on the bottom part of the lifting hole is carried out by adopting a drilling and injecting machine and retreating slurry injection lifting being performed in segments.

4. The high-rise building settling reinforcing and lifting correcting construction method according to claim 1, wherein, the foundation soil comprises a backfilled earth and stone layer, and a bottommost part of the backfilled earth and stone layer comprises one layer of soft soil layer; in step 2, the reinforcement slurry injection hole penetrates into the bottommost part of the backfilled earth and stone layer so that all the backfilled earth and stones in the curtain wall form the reinforcement body; in step 3, lifting slurry injection hole extends into the soft soil layer for pressure-injecting slurry.

5. The high-rise building settling reinforcing and lifting correcting construction method according to claim 1, wherein, the curtain wall hole penetrates into a bedrock layer.

6. The high-rise building settling reinforcing and lifting correcting construction method according to claim 1, wherein, when a cave exists right below the curtain wall hole, the curtain wall hole penetrates into the bottom part of the cave.

7. The high-rise building settling reinforcing and lifting correcting construction method according to claim 1, wherein, in step 3, drilling a hole obliquely downward from between an edge of the foundation slab of the building and the curtain wall to form the lifting hole, wherein the lifting hole extends into the bottom part of the reinforcement body.

8. The high-rise building settling reinforcing and lifting correcting construction method according to claim 1, wherein, the lifting hole extends right below a bearing wall or a structural column of the building.

9. The high-rise building settling reinforcing and lifting correcting construction method according to claim 1, wherein, the foundation soil comprises a backfilled earth and stone layer, after lift height reaches a requirement, hole position of an original reinforcement slurry injection hole of the building is continuously drilled downwards to the bottommost part of the backfilled earth and stone layer, the slurry injection is carried out by layering and retreating, and all backfilled earth and stones in the range of the foundation slab are strengthened and reinforced comprehensively.

10. The high-rise building settling reinforcing and lifting correcting construction method according to claim 1, wherein, after the lift height reaches the requirement, drilling a hole and carrying out slurry injection at four corners of the building and/or under an indoor main bearing wall to form an irregular composite pile foundation to support and reinforce the building.

* * * * *